US010435911B2

(12) United States Patent
Shi et al.

(10) Patent No.: US 10,435,911 B2
(45) Date of Patent: Oct. 8, 2019

(54) UTILITY POLE WITH ENERGY ABSORBING LAYER

(71) Applicant: Pepco Holdings LLC, Washington, DC (US)

(72) Inventors: Haijian Shi, Arlington, VA (US); Richard Steeg, Avondale, PA (US)

(73) Assignee: Pepco Holdings LLC, Washington, DC (US)

( * ) Notice: Subject to any disclaimer, the term of this patent is extended or adjusted under 35 U.S.C. 154(b) by 0 days.

(21) Appl. No.: 15/848,780

(22) Filed: Dec. 20, 2017

(65) Prior Publication Data

US 2019/0063100 A1 Feb. 28, 2019

Related U.S. Application Data

(60) Provisional application No. 62/550,192, filed on Aug. 25, 2017.

(51) Int. Cl.
*E04H 12/02* (2006.01)

(52) U.S. Cl.
CPC ..... *E04H 12/02* (2013.01)

(58) Field of Classification Search
CPC ..... E04H 12/02
See application file for complete search history.

(56) References Cited

U.S. PATENT DOCUMENTS 549,053 A 10/1895 Blow
1,532,734 A * 4/1925 Dean ..... E04H 12/2292 52/170
1,743,439 A * 1/1930 De Witt ..... E04H 12/08 24/486
1,891,736 A * 12/1932 Sporn ..... E04H 12/08 52/170
2,869,690 A * 1/1959 Winters ..... E04H 12/08 362/431
2,870,793 A 1/1959 Bailey
3,013,584 A 12/1961 Reed et al.
3,139,677 A * 7/1964 Goldstein ..... E04F 21/00 29/234
3,549,468 A * 12/1970 Yoshino ..... B23K 1/0014 156/304.1
3,798,867 A 3/1974 Starling
3,837,752 A * 9/1974 Shewchuk ..... F21V 21/06 248/158
3,850,813 A * 11/1974 Pall ..... B01D 29/111 210/232

(Continued)

FOREIGN PATENT DOCUMENTS

CN 206130342 U * 4/2017
DE 693703 C * 7/1940 ..... E04H 12/02

(Continued)

OTHER PUBLICATIONS

Machine Translation for DE 2708664 A1 (Year: 1977).*

(Continued)

*Primary Examiner* — Jeanette E Chapman
(74) *Attorney, Agent, or Firm* — Ballard Spahr LLP

(57) ABSTRACT

A stanchion such as a utility pole has an energy absorbing layer positioned proximate to the ground and surrounding the pole to absorb energy due to vehicular impact.

58 Claims, 6 Drawing Sheets

(56) References Cited

U.S. PATENT DOCUMENTS

| | | | | | |
|---|---|---|---|---|---|
| 4,242,851 | A * | 1/1981 | Pohlman | E04H 12/12 | 52/742.14 |
| 4,312,162 | A * | 1/1982 | Medney | E04H 12/16 | 52/223.4 |
| 4,666,130 | A | 5/1987 | Denman et al. | | |
| 4,680,069 | A | 7/1987 | Weyts | | |
| 5,211,846 | A * | 5/1993 | Kott | B01D 29/21 | 210/232 |
| 5,250,179 | A * | 10/1993 | Spearman | B01D 29/232 | 210/315 |
| 5,675,956 | A * | 10/1997 | Nevin | E04C 3/34 | 264/262 |
| 6,096,207 | A * | 8/2000 | Hoffman, Jr. | B01D 29/21 | 210/232 |
| 6,335,709 | B1 * | 1/2002 | Cummings | H01Q 1/1207 | 343/874 |
| 6,540,196 | B1 * | 4/2003 | Ellsworth | E01F 9/642 | 248/548 |
| 6,742,314 | B2 * | 6/2004 | Young | E04C 3/30 | 52/835 |
| 6,851,247 | B1 | 2/2005 | Turner et al. | | |
| 7,287,575 | B2 * | 10/2007 | Andersson | F28F 3/083 | 165/119 |
| 8,713,891 | B2 | 5/2014 | Carr et al. | | |
| 2003/0143036 | A1 * | 7/2003 | Larsen, Jr. | E02D 27/35 | 405/232 |
| 2011/0047900 | A1 | 3/2011 | Holmes | | |

FOREIGN PATENT DOCUMENTS

| | | | | |
|---|---|---|---|---|
| DE | 2708664 | A1 * | 9/1977 | E02D 27/42 |
| EP | 2400060 | | 12/2011 | |
| EP | 3081695 | | 10/2016 | |
| GB | 1087073 | | 10/1967 | |
| GB | 2389621 | | 12/2003 | |
| GB | 2396180 | | 6/2004 | |

OTHER PUBLICATIONS

Young, Lee W.; PCT International Search Report and Written Opinion regarding International Application No. PCT/US18/47277; Nov. 13, 2018.

* cited by examiner

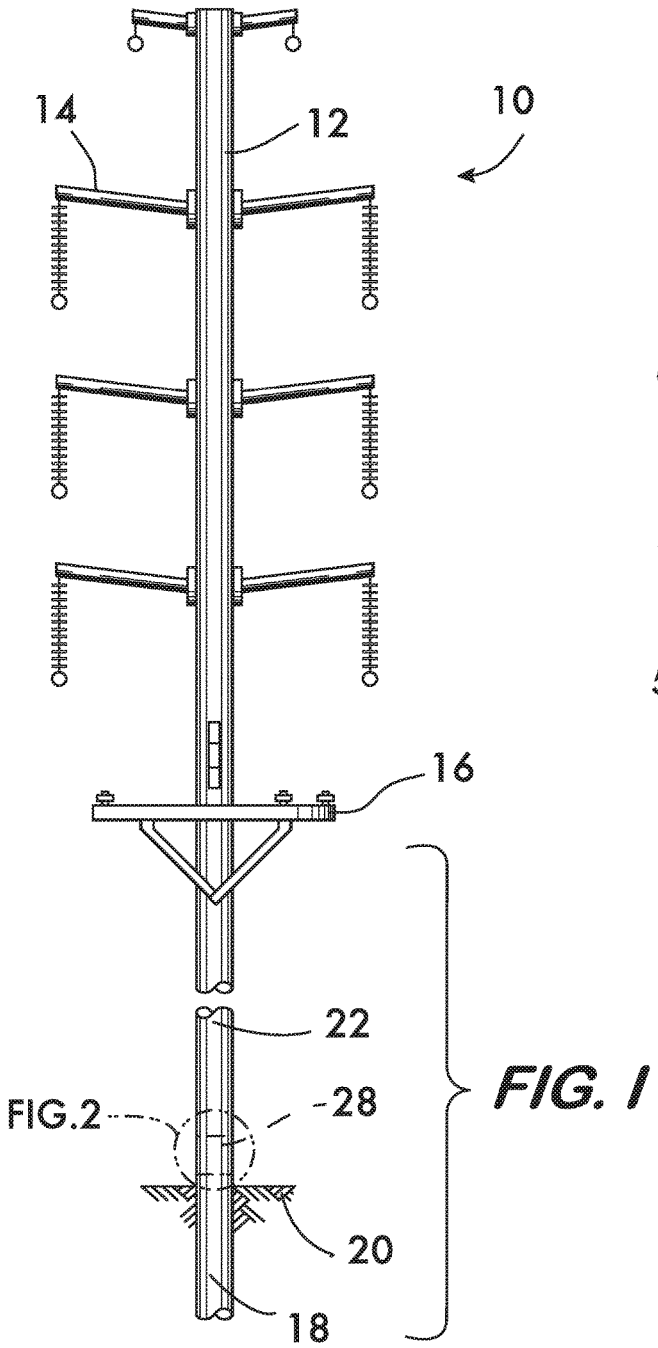
FIG. 1
FIG. 2
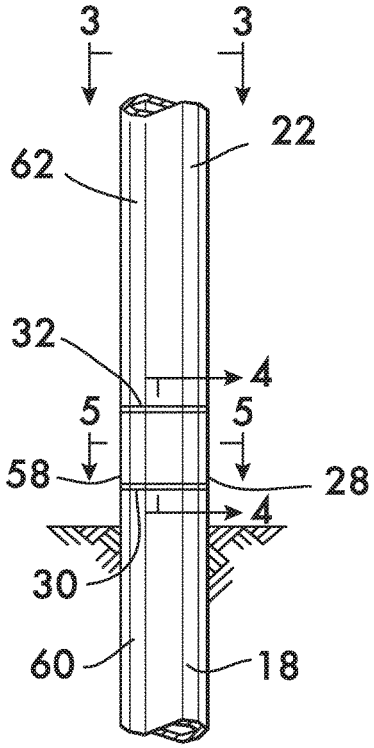

FIG. 6
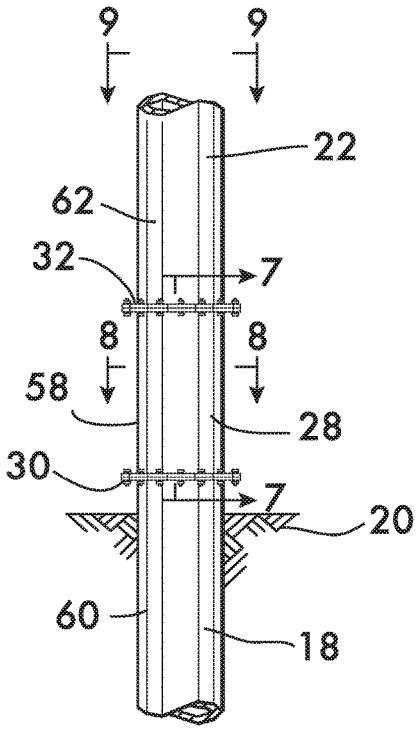
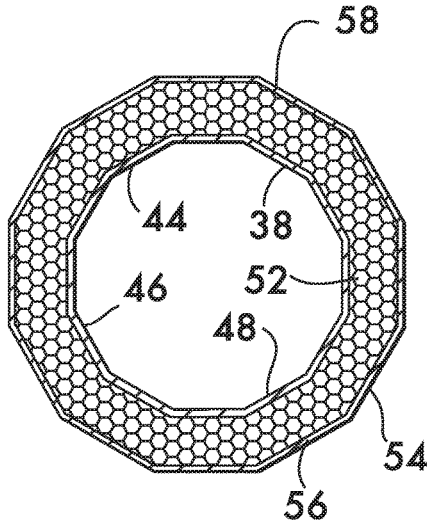
FIG. 8
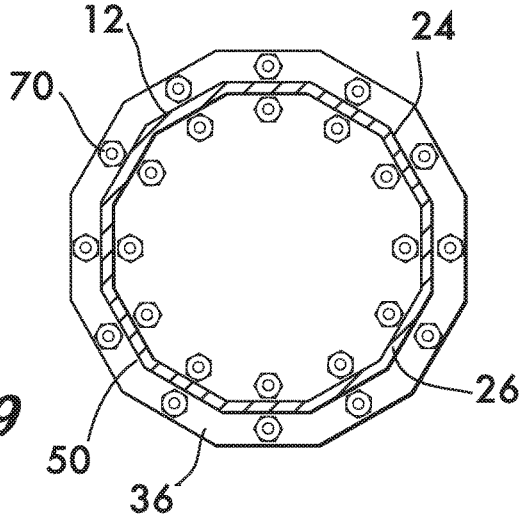
FIG. 9

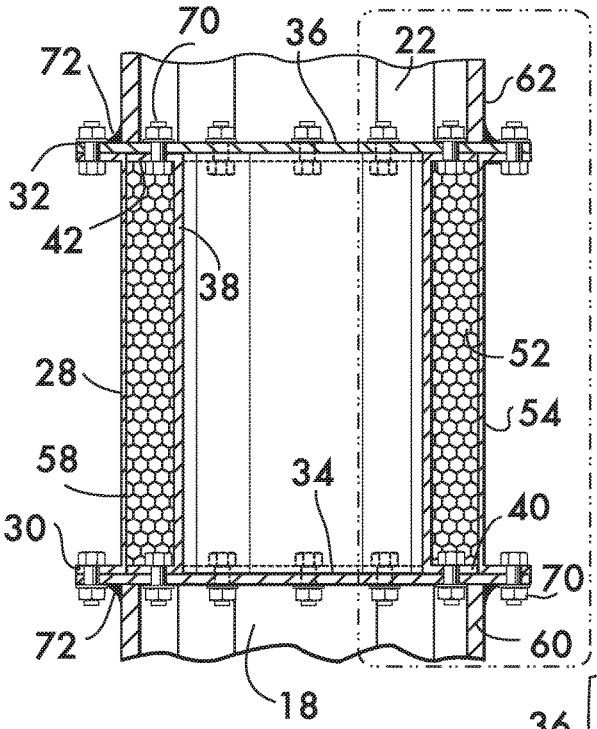
FIG. 7
FIG. 7A
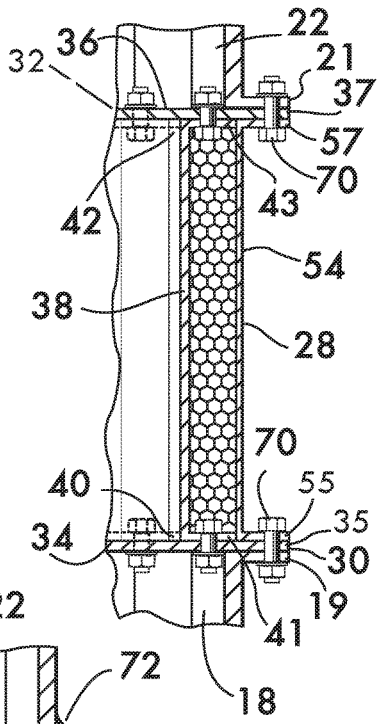
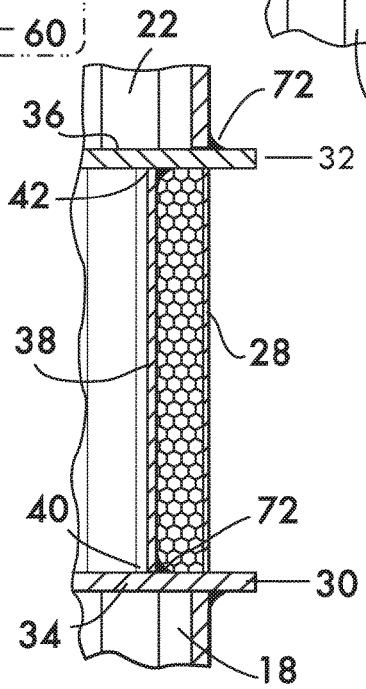
FIG. 7B

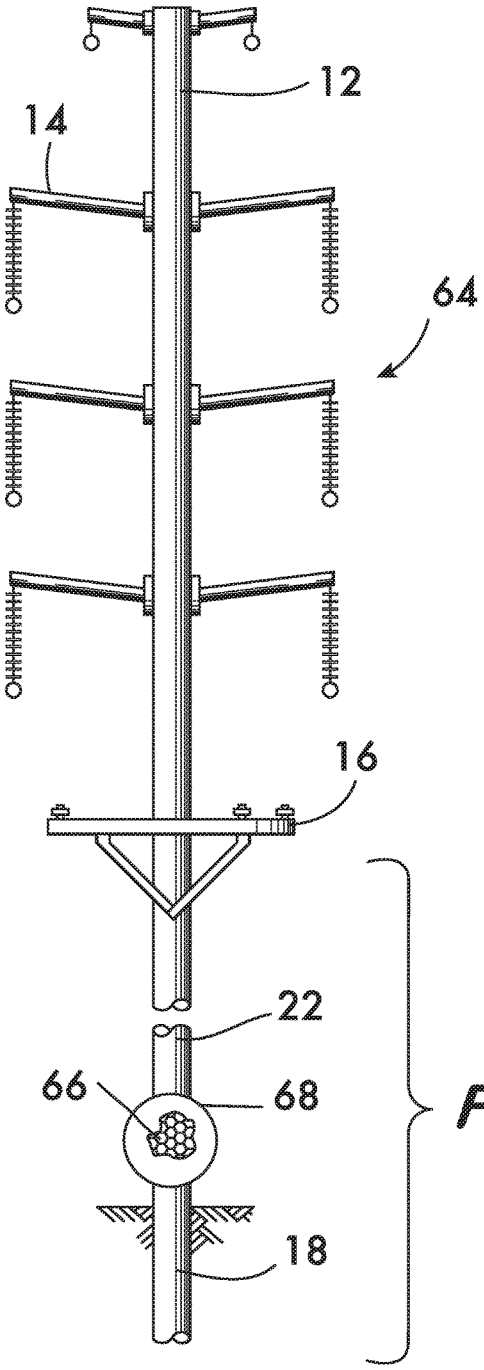
FIG. 10
FIG. 11
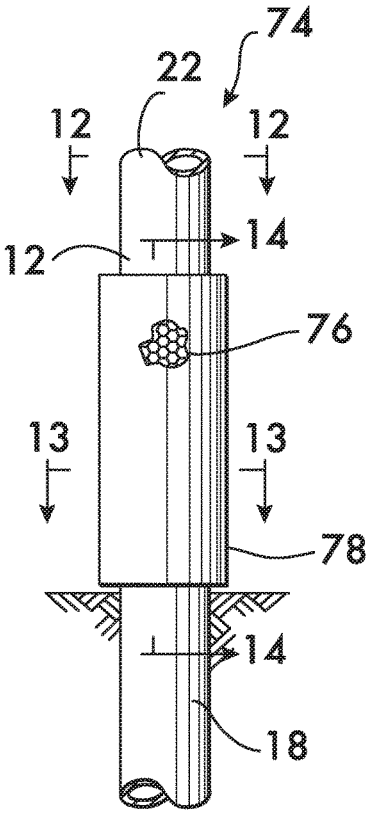

UTILITY POLE WITH ENERGY ABSORBING LAYER

CROSS REFERENCE TO RELATED APPLICATION

This application claims priority to U.S. Provisional Application No. 62/550,192, filed Aug. 25, 2017 and hereby incorporated by reference in its entirety.

FIELD OF THE INVENTION

This invention concerns stanchions, such as utility poles, having an energy absorbing layer to mitigate damage and severity of impact of a motor vehicle.

BACKGROUND

Stanchions, such as utility poles carrying electrical power lines, as well as supports for road signs and billboards, by virtue of their roadside position, are subject to collisions with motor vehicles, often traveling at relatively high speeds. The Insurance Institute for Highway Safety reports that of the 7,627 fatalities attributable to vehicle collisions with fixed objects in 2015, fully 12%, or about 915 deaths, occurred in collisions with utility poles. Statistics show that the number of fatalities has varied little year to year since 1979, which recorded over 10,000 fatalities due to fixed object collisions of all types. Furthermore, 40% of non-fatal collisions with utility poles result in injury. The cost of such collisions, including medical costs, disruption to electrical service, and repair of damaged poles tallies in the billions. There is clearly an opportunity to improve safety and crashworthiness of roadside stanchions such as utility poles and thereby reduce fatalities and associated costs.

SUMMARY

This invention concerns a utility pole for supporting electrical power lines. In one example embodiment the pole comprises a first pole portion, a second pole portion, an attachment segment, and an energy absorbing layer surrounding the attachment segment. The first pole portion is adapted to be positioned at least partially below ground. The second pole portion is adapted to extend above ground and support the power lines. The attachment segment has a first end attached to the first pole portion and a second end attached to the second pole portion. The attachment segment is adapted to be positioned above and proximate to the ground. The energy absorbing layer has a lower compression strength than the first and second pole portions.

In a particular example embodiment the attachment segment has a first bulkhead, a second bulkhead and a tube. The first bulkhead is attached to the first pole portion. The second bulkhead is attached to the second pole portion. The tube has a first end attached to the first bulkhead and a second end attached to the second bulkhead. In another example the tube is coaxially aligned with the first and second pole portions. In another example the tube has a smaller perimeter than said first and second pole portions. Another example further comprises a sleeve surrounding said tube. In another example the sleeve is arranged coaxially with the tube. In another example the sleeve has a perimeter equal to the perimeter of the first and second pole portions.

In another example, the energy absorbing layer is positioned between the sleeve and the tube. In another example the energy absorbing layer comprises foamed aluminum. In another example the energy absorbing layer comprises a resilient, elastic material. In another example the energy absorbing layer comprises rubber.

In a further example, the energy absorbing layer surrounds the tube. By way of example energy absorbing layer comprises foamed aluminum. In another example, energy absorbing layer comprises a resilient, elastic material. In another example, energy absorbing layer comprises rubber.

By way of example the attachment segment first end is bolted to the first pole portion. In another example the attachment segment first end is welded to the first pole portion. In another example attachment segment second end is bolted to the second pole portion. In another example the attachment segment second end is welded to the second pole portion.

By way of example the first bulkhead is bolted to the first pole portion. In another example the first bulkhead is welded to the first pole portion. In another example the second bulkhead is bolted to the second pole portion. In another example the second bulkhead is welded to the second pole portion. In another example the tube first end is bolted to the first bulkhead. In another example the tube first end is welded to the first bulkhead. In another example the tube second end is bolted to the second bulkhead. In another example the tube second end is welded to the second bulkhead.

In an example embodiment the sleeve has a perimeter greater than a perimeter of said first and second pole portions.

In another example embodiment a stanchion comprises a first stanchion portion, a second stanchion portion, an attachment segment, and an energy absorbing layer surrounding the attachment segment. The first stanchion portion is adapted to be positioned at least partially below ground. The second stanchion portion is adapted to extend above ground. The attachment segment has a first end attached to the first stanchion portion and a second end attached to the second stanchion portion. The attachment segment is adapted to be positioned above and proximate to the ground. The energy absorbing layer has a lower compression strength than the first and second stanchion portions.

In a particular example embodiment the attachment segment has a first bulkhead, a second bulkhead and a tube. The first bulkhead is attached to the first stanchion portion. The second bulkhead is attached to the second stanchion portion. The tube has a first end attached to the first bulkhead and a second end attached to the second bulkhead. In another example the tube is coaxially aligned with the first and second stanchion portions. In another example the tube has a smaller perimeter than said first and second stanchion portions. Another example further comprises a sleeve surrounding said tube. In another example the sleeve is arranged coaxially with the tube. In another example the sleeve has a perimeter equal to the perimeter of the first and second stanchion portions.

In another example the energy absorbing layer is positioned between the sleeve and the tube. In another example the energy absorbing layer comprises foamed aluminum. In another example the energy absorbing layer comprises a resilient, elastic material. In another example the energy absorbing layer comprises rubber.

In a further example, the energy absorbing layer surrounds the tube. By way of example energy absorbing layer comprises foamed aluminum. In another example, energy absorbing layer comprises a resilient, elastic material. In another example, energy absorbing layer comprises rubber.

In another example the stanchion further comprises at least one light mounted on the second stanchion portion. In another example the stanchion further comprises at least one sign mounted on the second stanchion portion.

By way of example the attachment segment first end is bolted to the first stanchion portion. In another example the attachment segment first end is welded to the first stanchion portion. In another example attachment segment second end is bolted to the second stanchion portion. In another example the attachment segment second end is welded to the second stanchion portion.

By way of example the first bulkhead is bolted to the first stanchion portion. In another example the first bulkhead is welded to the first stanchion portion. In another example the second bulkhead is bolted to the second stanchion portion. In another example the second bulkhead is welded to the second stanchion portion. In another example the tube first end is bolted to the first bulkhead. In another example the tube first end is welded to the first bulkhead. In another example the tube second end is bolted to the second bulkhead. In another example the tube second end is welded to the second bulkhead.

In an example embodiment the sleeve has a perimeter greater than a perimeter of said first and second stanchion portions.

BRIEF DESCRIPTION OF THE DRAWINGS

FIG. 1 is an elevational view of an example embodiment of a utility pole according to the invention;

FIG. 2 is an elevational view on an enlarged scale of a portion of the utility pole shown in FIG. 1;

FIG. 6 is an elevational view of an enlarged scale of a portion of the utility pole shown in FIG. 1 illustrating a bolted embodiment;

FIG. 7 is a longitudinal sectional view taken at line 7-7 of FIG. 6;

FIG. 7A is a longitudinal sectional view of an alternative embodiment of FIG. 7;

FIG. 7B is a longitudinal sectional view of an alternative embodiment of FIG. 7;

FIG. 8 is a cross sectional view taken at line 8-8 of FIG. 6;

FIG. 9 is a cross sectional view taken at line 9-9 of FIG. 6;

FIG. 10 is an elevational view of another example embodiment of a utility pole according to the invention;

FIG. 11 is an elevational view of another example embodiment of a portion of a utility pole according to the invention;

DETAILED DESCRIPTION

FIG. 1 shows an elevational view of an example stanchion 10 according to the invention. In this example, stanchion 10 is a utility pole 12, for example, a 69 kV to 130 kV voltage class pole having a height of about 80 feet and arms 14 and/or cross members 16 for supporting electrical power lines (not shown). Stanchion 10 may also be used to support other elements, for example lights or signs, such as road signs or advertising, however, the invention is described in terms of a utility pole, it being understood that the claimed structure may be applied to any type of stanchion for any use.

Figure 3:
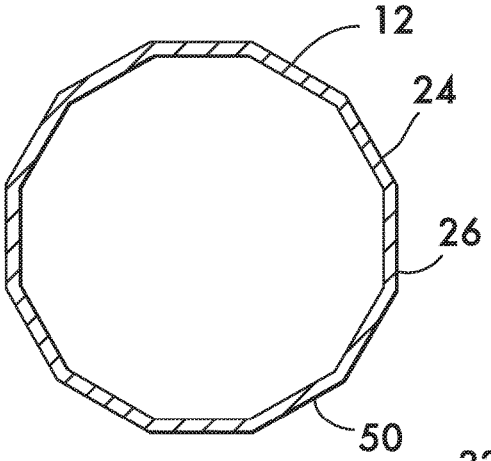
FIG. 3 is a cross sectional view taken at line 3-3 of FIG. 2.

Pole 12 comprises a first pole portion 18 adapted to be positioned below ground 20 and anchor the pole 12 in place. Additional anchoring may be provided by, for example concrete footings or casements (not shown) at or below ground level. A second pole portion 22 is adapted to extend above ground 20, the second pole portion supporting structures such as arms 14 and cross members 16. Pole portions 18 and 22 may have any cross sectional shape, the example pole 12 cross section being shown in FIG. 3 as a 12 sided polygon 24 having sides 26 of ¼ inch to ¾ inch thick steel. Other materials, such as aluminum are of course feasible. As shown in FIGS. 1 and 2, an attachment segment 28 has a first end 30 attached to the first pole portion 18 and a second end 32 attached to the second pole portion 22. Attachment segment 28 effects attachment between the pole portions 18 and 22 and is adapted to be positioned above and proximate to the ground 20. In this example the pole portions 18 and 22 and the attachment segment 28 are all coaxially aligned.

Figure 4:
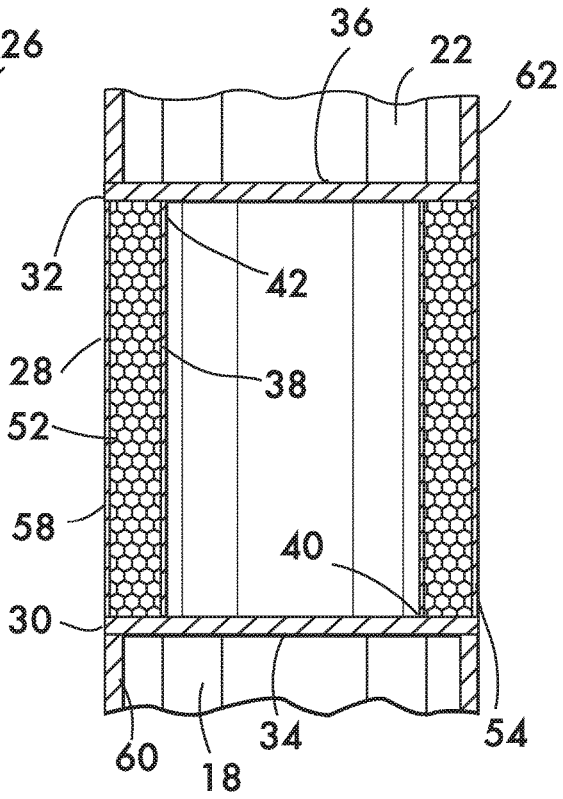
FIG. 4 is a longitudinal sectional view taken at line 4-4 of FIG. 2.
Figure 5:
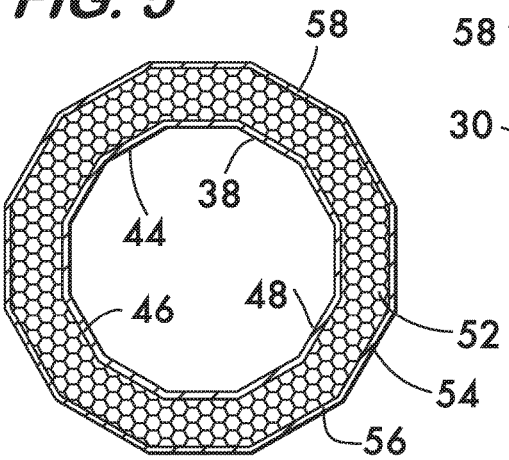
FIG. 5 is a cross sectional view taken at line 5-5 of FIG. 2.

In the example embodiment shown in FIG. 4, the attachment segment 28 comprises a first bulkhead 34 attached to the first pole portion 18 and a second bulkhead 36 attached to the second pole portion 22. In this example the bulkheads 34 and 36 comprise ½ inch thick steel plate, but the thicknesses may range from ¼ inch to ¾ inch by way of example. A tube 38 has a first end 40 attached to the first bulkhead 34 and a second end 42 attached to the second bulkhead 36. As shown in FIG. 5, tube 38 has a polygonal cross section 44 with sides 46 formed of ½ inch steel. Thicknesses from ¼ inch to ¾ inch are also practical. Other cross sectional shapes and materials are of course feasible. Tube 38 is coaxially aligned with the pole portions 18 and 22 and has a smaller perimeter 48 than the perimeters 50 of the pole portions (see FIG. 3). Attachment of the bulkheads 34 and 36 to their respective pole portions 18 and 22, as well as attachment between the ends 40 and 42 of tube 38 to respective bulkheads 34 and 36 are practically effected by welding in this example embodiment, but may also be attached via fasteners, such as bolts and nuts engaging flanges. The particular design details provided herein are by way of example only and the various plate and tube diameters, lengths, thicknesses, materials and attachment means will be determined by specific design requirements, for example, the height and voltage class for utility poles, or the weight and size of signage as well as the maximum wind speed expected at the location of the supporting stanchion or pole.

As further shown in FIGS. 4 and 5, an energy absorbing layer 52 surrounds the attachment segment 28. Energy absorbing layer 52 has a lower compression strength than the pole portions 18 and 22 and the attachment segment 28, allowing it to deform plastically and absorb energy when subjected to an impact, for example from a vehicle. By absorbing the impact energy with layer 52 the structural integrity of the pole 12 is maintained, preventing collapse of the pole, and the severity of the deceleration of the vehicle is lessened, thereby mitigating injury to the vehicle occupants. As shown in FIGS. 1 and 2, the energy absorbing layer 52 is positioned above but proximate to the ground 20 over a region of pole 12 which is likely to be struck by a vehicle. In a particular example embodiment the length of the attachment segment 28 and the energy absorbing layer 52 is about 24 inches, and the first bulkhead 34 is positioned about 18 inches from the ground. Other lengths and positions are of course feasible and will be determined by various environment factors such as the height and geographic location of the pole as well as the size, weight and type of vehicles expected to be encountered to name a few factors.

In an example embodiment shown in FIGS. 4 and 5 the energy absorbing layer comprises foamed aluminum. A three inch thick layer of foamed aluminum having high porosity, for example 80% porosity with an average pore size of 2 to 5 mm, has a compressive strength less than steel from which the rest of the example pole is formed and is expected to provide an effective level of energy absorption to preserve pole integrity and mitigate the severity of vehicle impact through plastic deformation. In an alternative embodiment, the energy absorbing layer may comprise a honeycomb structure made from aluminum, plastic or composite materials and may be captive or free floating. In another example embodiment, the energy absorbing layer 52 may comprise a flexible, resilient material such as rubber a rubber compound, or a gel. Other energy absorbing materials include D3o™, developed by D3o Labs in the UK, engineered polyurethane, such as Sorbothane™, manufactured and distributed by Sorbothane Inc., of Kent Ohio, and engineered silicone gel, such as Impact Gel™, manufactured by Impact Gel of Ettrick, Wis. Energy absorption of such a layer is expected to be through substantially elastic or rheological deformation.

In the example embodiment, a sleeve 54 surrounds the tube 38. Sleeve 54 is arranged coaxially with the tube 38 and protects the energy absorbing layer 52. The sleeve 54 may have a perimeter 56 of the same cross section shape and equal in dimensions to the perimeters of the first and second pole portions and thus form an outer surface 58 substantially continuous with the outer surfaces 60 and 62 of the pole portions 18 and 22 (see FIGS. 2 and 4). The energy absorbing layer 52 is captured between the sleeve 54 and the tube 38, and the size of the sleeve may be enlarged to afford a thicker energy absorbing layer 52 if required.

FIGS. 6 and 7 illustrate an example embodiment attachment means for attachment segment 28 first and second ends, 30 and 32, to respective first and second pole segments, 18 and 22. Attachment segment 28 is coaxially aligned with pole segments 18 and 22. In the example embodiment shown in FIG. 7, the attachment segment 28 comprises a first bulkhead 34 attached to first pole portion 18 and a second bulkhead 36 attached to the second pole portion 22.

Attachment details for example embodiments are shown in FIGS. 7A and 7B. FIG. 7A illustrates bolted attachment details. First and second pole portions 18 and 22 have first and second pole portion flanges 19 and 21 to facilitate fastening. Attachment segment 28 first and second ends 30 and 32 attach to the respective first and second pole portions 18 and 22 via bolts 70 connecting first and second pole portion flanges 19 and 21 with first and second attachment ends 30 and 32. The first and second bulkheads 34 and 36 have first and second bulkhead flanges 35 and 37 to facilitate fastening. The first and second bulkheads 34 and 36 attach to the respective first and second pole portions 18 and 22 via bolts 70 connecting first and second pole portion flanges 19 and 21 with first and second bulkhead flanges 35 and 37. Tube 38, having first and second tube ends 40 and 42, is coaxially aligned with the first and second bulkheads 34 and 36. First and second tube ends 40 and 42 have first and second tube end flanges 41 and 43 to facilitate fastening. The first and second tube ends 40 and 42 attach to the respective first and second bulkheads 34 and 36 via bolts 70 connecting first and second tube end flanges 41 and 43 with first and second bulkheads 34 and 36. The bolt pattern for the bulkhead to tube end flange connection is illustrated as the inner bolt pattern in FIG. 9. In this example sleeve 54, shown in FIG. 7A, has first and second sleeve flanges 55 and 57. The sleeve 54 is coaxially aligned with the first and second bulkheads 34 and 36. The first and second sleeve flanges 55 and 57 attach to the respective first and second bulkheads 34 and 36 via bolts 70 connecting first and second flanges 55 and 57 to first and second bulkhead flanges 35 and 37. The aforementioned bolted connections could be bolts with nuts engaging flanges or bolts through a flange into a threaded insert or a tapped hole.

The welded attachment details for an example embodiment are illustrated in FIG. 7B. Attachment segment first and second ends 30 and 32 attach to the respective first and second pole portions 18 and 22 via welds 72. The first and second bulkheads, 34 and 36 attach to the respective first and second pole portions 18 and 22 via welds 72. The first and second tube ends 40 and 42 attach to the respective first and second bulkheads 34 and 36 via welds 72. Combinations of bolted and welded connections are also feasible and will be determined by installation considerations and specific design requirements, for example, the height and voltage class for utility poles, or the weight and size of signage as well as the maximum wind speed expected at the location for the supporting stanchion or pole.

As shown in FIG. 8, tube 38 has a polygonal cross section 44 with sides 46 and has a smaller perimeter 48 than the perimeters 50 of the pole portions in FIG. 9. Sleeve 54, shown in FIG. 8, is coaxially aligned with tube 38. FIG. 9 illustrates the first and second bulkheads 34 and 36 extending beyond the perimeter 50 of the pole portions 18 and 22 to facilitate the attachment of the sleeve 54. The sleeve 54, shown in FIG. 7, is bolted to the first and second bullheads 34 and 36, but may also be attached via welding.

FIG. 10 shows another embodiment 64, wherein the energy absorbing layer 66 has a concave shape, and the sleeve 68 surrounding the layer 66 is also concave.

Figure 12:
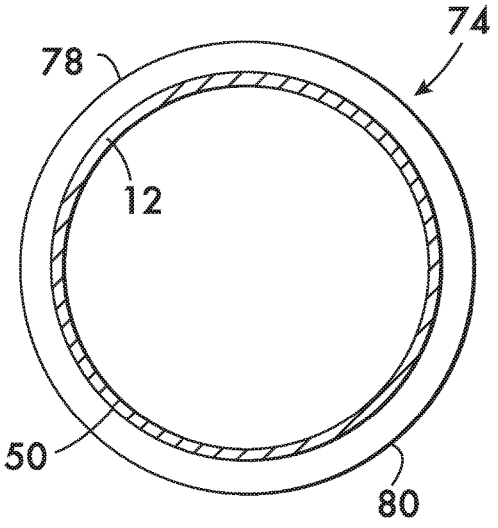
FIG. 12 is a cross sectional view taken at line 12-12 of FIG. 11.
Figure 14:
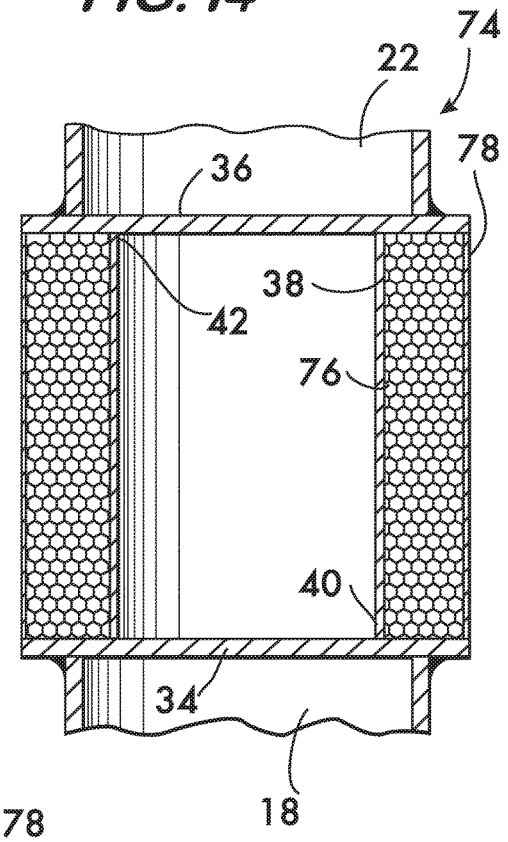
FIG. 14 is a longitudinal sectional view taken at line 14-14 of FIG. 11.
Figure 13:
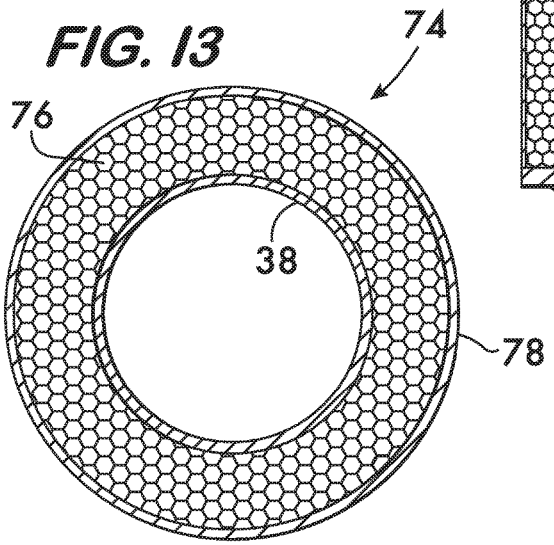
FIG. 13 is a cross sectional view taken at line 13-13 of FIG. 11.

FIG. 11 is an elevational view of another embodiment 74. In this embodiment the energy absorbing layer 76 extends beyond the outer perimeter 50 of pole portions 18 and 22, see also FIG. 12. The example pole 12 is shown in FIG. 12 with a circular cross section with ¼ inch thick steel. Thicknesses from ⅛ inch to ½ inch are also practical. The sleeve 78 in this embodiment has a perimeter 80 greater than a perimeter 50 of pole portions 18 and 22. FIG. 13 illustrates tube 38 and sleeve 78 having circular cross sections. In this example tube 38 is ¼ inch thick steel and sleeve 78 is 1/32 inch thick steel. The energy absorbing layer 76 in the example shown in FIG. 14 is five inches thick. In FIG. 14, attachment of bulkheads 34 and 36 to their respective pole portions 18 and 22, attachment between ends 40 and 42 of tube 38 to respective bulkheads 34 and 36, as well as the attachment between sleeve 78 and bulkheads 34 and 36 are practically effected by welding, but may also be attached via fasteners, such as bolts and nuts engaging flanges.

Embodiments 64 and 74 permit the energy absorbing layer to be enlarged relative to the diameter of the pole portions 18 and 22 as needed to absorb more energy as the situation requires.

Stanchions 10 such as utility poles 12 described herein are expected to prevent or lessen the collapse of such structures when struck by a vehicle while also mitigating injury and death of vehicle occupants.

What is claimed is:

1. A utility pole for supporting electrical power lines, said pole comprising:

a first pole portion adapted to be positioned at least partially below ground;

a second pole portion adapted to extend above ground and support said power lines;

an attachment segment having a first end attached to said first pole portion and a second end attached to said second pole portion, said attachment segment adapted to be positioned above and proximate to ground;

an energy absorbing layer surrounding said attachment segment, said energy absorbing layer having a lower compression strength than said first and said second pole portions.

2. The utility pole according to claim 1, wherein said attachment segment comprises:

a first bulkhead attached to said first pole portion;

a second bulkhead attached to said second pole portion;

a tube having a first end attached to said first bulkhead and a second end attached to said second bulkhead.

3. The utility pole according to claim 2, wherein said tube is coaxially aligned with said first and second pole portions.

4. The utility pole according to claim 2, wherein said tube has a smaller perimeter than said first and second pole portions.

5. The utility pole according to claim 4, further comprising a sleeve surrounding said tube.

6. The utility pole according to claim 5, wherein said sleeve is arranged coaxially with said tube.

7. The utility pole according to claim 6, wherein said sleeve has a perimeter equal to a perimeter of said first and second pole portions.

8. The utility pole according to claim 5, wherein said energy absorbing layer is positioned between said sleeve and said tube.

9. The utility pole according to claim 8, wherein said energy absorbing layer comprises foamed aluminum.

10. The utility pole according to claim 8, wherein said energy absorbing layer comprises a resilient, elastic material.

11. The utility pole according to claim 10, wherein said energy absorbing layer comprises rubber.

12. The utility pole according to claim 2, wherein said energy absorbing layer surrounds said tube.

13. The utility pole according to claim 12, wherein said energy absorbing layer comprises foamed aluminum.

14. The utility pole according to claim 12, wherein said energy absorbing layer comprises a resilient, elastic material.

15. The utility pole according to claim 14, wherein said energy absorbing layer comprises rubber.

16. The utility pole according to claim 1, wherein said attachment segment first end is bolted to said first pole portion.

17. The utility pole according to claim 1, wherein said attachment segment first end is welded to said first pole portion.

18. The utility pole according to claim 1, wherein said attachment segment second end is bolted to said second pole portion.

19. The utility pole according to claim 1, wherein said attachment segment second end is welded to said second pole portion.

20. The utility pole according to claim 2, wherein said first bulkhead is bolted to said first pole portion.

21. The utility pole according to claim 2, wherein said first bulkhead is welded to said first pole portion.

22. The utility pole according to claim 2, wherein said second bulkhead is bolted to said second pole portion.

23. The utility pole according to claim 2, wherein said second bulkhead is welded to said second pole portion.

24. The utility pole according to claim 2, wherein said tube first end is bolted to said first bulkhead.

25. The utility pole according to claim 2, wherein said tube first end is welded to said first bulkhead.

26. The utility pole according to claim 2, wherein said tube second end is bolted to said second bulkhead.

27. The utility pole according to claim 2, wherein said tube second end is welded to said second bulkhead.

28. The utility pole according to claim 6, wherein said sleeve has a perimeter greater than a perimeter of said first and second pole portions.

29. A stanchion, said stanchion comprising:

a first stanchion portion adapted to be positioned at least partially below ground;

a second stanchion portion adapted to extend above ground;

an attachment segment having a first end attached to said first stanchion portion and a second end attached to said second stanchion portion, said attachment segment adapted to be positioned above and proximate to ground;

an energy absorbing layer surrounding said attachment segment, said energy absorbing layer having a lower compression strength than said first and said second stanchion portions.

30. The stanchion according to claim 29, wherein said attachment segment comprises:

a first bulkhead attached to said first stanchion portion;

a second bulkhead attached to said second stanchion portion;

a tube having a first end attached to said first bulkhead and a second end attached to said second bulkhead.

31. The stanchion according to claim 30, wherein said tube is coaxially aligned with said first and second stanchion portions.

32. The stanchion according to claim 30, wherein said tube has a smaller perimeter than said first and second stanchion portions.

33. The stanchion according to claim 32, further comprising a sleeve surrounding said tube.

34. The stanchion according to claim 33, wherein said sleeve is arranged coaxially with said tube.

35. The stanchion according to claim 34, wherein said sleeve has a perimeter equal to a perimeter of said first and second stanchion portions.

36. The stanchion according to claim 33, wherein said energy absorbing layer is positioned between said sleeve and said tube.

37. The stanchion according to claim 36, wherein said energy absorbing layer comprises foamed aluminum.

38. The stanchion according to claim 36, wherein said energy absorbing layer comprises a resilient, elastic material.

39. The stanchion according to claim 38, wherein said energy absorbing layer comprises rubber.

40. The stanchion according to claim 30, wherein said energy absorbing layer surrounds said tube.

41. The stanchion according to claim 40, wherein said energy absorbing layer comprises foamed aluminum.

42. The stanchion according to claim 40, wherein said energy absorbing layer comprises a resilient, elastic material.

43. The stanchion according to claim 42, wherein said energy absorbing layer comprises rubber.

44. The stanchion according to claim 29, further comprising at least one light mounted on said second stanchion portion.

45. The stanchion according to claim 29, further comprising at least one sign mounted on said second stanchion portion.

46. The stanchion according to claim 29, wherein said attachment segment first end is bolted to said first stanchion portion.

47. The stanchion according to claim 29, wherein said attachment segment first end is welded to said first stanchion portion.

48. The stanchion according to claim 29, wherein said attachment segment second end is bolted to said second stanchion portion.

49. The stanchion according to claim 29, wherein said attachment segment second end is welded to said second stanchion portion.

50. The stanchion according to claim 30, wherein said first bulkhead is bolted to said first stanchion portion.

51. The stanchion according to claim 30, wherein said first bulkhead is welded to said first stanchion portion.

52. The stanchion according to claim 30, wherein said second bulkhead is bolted to said second stanchion portion.

53. The stanchion according to claim 30, wherein said second bulkhead is welded to said second stanchion portion.

54. The stanchion according to claim 30, wherein said tube first end is bolted to said first bulkhead.

55. The stanchion according to claim 30, wherein said tube first end is welded to said first bulkhead.

56. The stanchion according to claim 30, wherein said tube second end is bolted to said second bulkhead.

57. The stanchion according to claim 30, wherein said tube second end is welded to said second bulkhead.

58. The stanchion according to claim 34, wherein said sleeve has a perimeter greater than a perimeter of said first and second stanchion portions.

* * * * *